US012722042B2

(12) United States Patent
Park

(10) Patent No.: US 12,722,042 B2
(45) Date of Patent: Sep. 1, 2026

(54) METHOD FOR ANALYZING GOLF SWING

(71) Applicant: DMBH CO., LTD., Bucheon-si (KR)

(72) Inventor: Yong Gil Park, Seongnam-si (KR)

(73) Assignee: DMBH CO., LTD., Bucheon-si (KR)

( * ) Notice: Subject to any disclaimer, the term of this patent is extended or adjusted under 35 U.S.C. 154(b) by 253 days.

(21) Appl. No.: 18/740,593

(22) Filed: Jun. 12, 2024

(65) Prior Publication Data

US 2025/0325873 A1 Oct. 23, 2025

(30) Foreign Application Priority Data

Apr. 19, 2024 (KR) ..... 10-2024-0052954

(51) Int. Cl.
*G01P 15/00* (2006.01)
*A63B 24/00* (2006.01)
*A63B 69/36* (2006.01)

(52) U.S. Cl.
CPC ..... *A63B 24/0006* (2013.01); *A63B 69/36* (2013.01); *A63B 2024/0009* (2013.01); *A63B 2220/806* (2013.01)

(58) Field of Classification Search
CPC ..... A63B 24/0006; A63B 69/36; A63B 2024/0009; A63B 2220/806; A63B 69/3608; A63B 2024/0012; A63B 2102/32; A63B 2220/40; A63B 2220/833; A63B 2220/836; A63B 69/3632; A63B 71/0622
See application file for complete search history.

(56) References Cited

U.S. PATENT DOCUMENTS

| | | | | |
|---|---|---|---|---|
| 10,016,670 | B2 * | 7/2018 | Sato | A61B 5/1122 |
| 12,090,365 | B2 * | 9/2024 | Vermilyea | A63F 13/213 |
| 2019/0108391 | A1 * | 4/2019 | Matsuzawa | G06V 40/25 |
| 2025/0325873 | A1 * | 10/2025 | Park | A63B 24/0006 |

FOREIGN PATENT DOCUMENTS

| | | | |
|---|---|---|---|
| KR | 10-1428922 | B1 | 8/2014 |
| KR | 10-1525411 | B1 | 6/2015 |
| KR | 10-1913667 | B1 | 10/2018 |
| KR | 10-2514697 | B1 | 3/2023 |
| KR | 10-2024-0028826 | A | 3/2024 |

* cited by examiner

*Primary Examiner* — Howard D Brown, Jr.
(74) *Attorney, Agent, or Firm* — Revolution IP, PLLC

(57) ABSTRACT

The present invention relates to a method for analyzing the golf swing, and more specifically, to a method for analyzing the golf swing, which compares a swing angle of a user with a swing angle of a comparative model, and calculates lengths of the arm and a golf club based on a predefined specific arm length or a predefined specific club length, such that despite variations in the user's body size or club length, comparisons can be made using standardized arm and club lengths, thereby enabling more accurate golf swing analysis.

5 Claims, 8 Drawing Sheets

(a)

(b)

(c)

METHOD FOR ANALYZING GOLF SWING

BACKGROUND OF THE INVENTION

Field of the Invention

The present invention relates to a method for analyzing the golf swing, and more specifically, to a method for analyzing the golf swing, which compares a swing angle of a user with a swing angle of a comparative model, and calculates lengths of the arm and a golf club based on a predefined specific arm length or a predefined specific club length, such that despite variations in the user's body size or club length, comparisons can be made using standardized arm and club lengths, thereby enabling more accurate golf swing analysis.

Background Art

To analyze the golf swing, generally, a swing plane is used as illustrated in FIG. 7(*a*), or assessing a desirable swing motion based on a continuous motion such as a swing trajectory of the club, as illustrated in FIG. 7(*b*), is performed. Commonly, correction information is provided to compare a user's swing plane with the standard swing plane or compare the swing trajectories.

For this purpose, a camera sensor and an inertial sensor are generally used. The camera sensor involves recording and replaying the swing, but has a disadvantage in that the user has to draw the swing plane to analyze the golf swing, and is mostly used for acquiring club information. To accurately acquire information of the wrist motion, a high-speed camera is required, and if necessary, there is a need to attach markers.

Moreover, an inertial measurement unit (IMU) typically includes a three-axis acceleration sensor, a three-axis angular velocity sensor (gyro sensor), and a magnetic sensor. To find out a location, a method of double integrating acceleration components is mainly used. However, to extract position information through the double integration, it is necessary to know the initial position value, which can vary according to the user's physical characteristics (height, arm length, shoulder width, etc.), types of clubs, and address postures, and can vary whenever the method is used. Furthermore, the golf swing is a rapid rotational movement where acceleration components mix with gravity, centrifugal force, and Coriolis effects due to the interaction between the arm and the club, making it very difficult to accurately determine position.

To solve the problems, conventional methods using inertial sensors have been proposed to calculate the positions of the arm and the club more accurately by calculating the positions of the arm and the club from angle values of the inertial sensors.

However, the traditional methods have a problem that it is difficult to accurately analyze the user's golf swing just by the angle information calculated through the conventional methods since the user's body characteristics (such as arm length) vary and the lengths of the clubs are also diverse.

Meanwhile, the golf swing analysis technologies have been widely known, and particularly, are described in the following patent documents in detail. So, further description and illustration of the technologies are omitted.

PATENT LITERATURE

Patent Documents

Patent Document 1: Korean Patent No. 10-1913667
Patent Document 2: Korean Patent No. 10-2514697

Patent Document 1: Korean Patent No. 10-1428922
Patent Document 1: Korean Patent No. 10-1525411
Patent Document 1: Korean Patent Publication No. 10-2024-0028826

SUMMARY OF THE INVENTION

Accordingly, the present invention has been made to solve the above-mentioned problems occurring in the prior arts, and it is an object of the present invention to provide a method for analyzing the golf swing, which compares a swing angle of a user with a swing angle of a comparative model, and calculates lengths of the arm and a golf club based on a predefined specific arm length or a predefined specific club length, such that despite variations in the user's body size or club length, comparisons can be made using standardized arm and club lengths, thereby enabling more accurate golf swing analysis.

The objectives of the present disclosure are not limited to those mentioned above, and other objectives not mentioned herein will be clearly understood by those skilled in the art from the following description.

To accomplish the above object, according to the present invention, there is provided a method for analyzing the golf swing including: using a first inertial sensor mounted on a user's arm and a second inertial sensor mounted on one side of a club to calculate the angles of the user and a comparative model, wherein the user's angles are angles of the user's arm and club, and the model's angles are angles of the model's arm and club, and trajectories of the arm and the club based on the user's angles and trajectories of the arm and the club based on based on the model's angles are simultaneously displayed and compared by using arbitrarily selected lengths of the arm and the club.

Moreover, the user's arm or the comparative model's arm is represented as first lines, and the user's club or the comparative model's club is represented as second lines, the first lines are arranged such that all starting points of the first lines coincide when the first lines are formed, the second lines are formed at the ends of the first lines, a length of the first line is an arbitrarily selected length of the arm, and a length of the second line is an arbitrarily selected length of the club, and the first lines of the user and the first lines of the comparative model are formed to have the same length, and the second lines of the user and the second lines of the comparative model are also formed to have the same length, and then, are compared with each other.

Furthermore, the first line includes a line 11 corresponding to the user's arm, and a line 21 corresponding to the comparative model's arm, the second line includes a line 21 corresponding to the user's club, and a line 22 corresponding to the comparative model's club, angles (angles between the arm and a straight line in the direction of gravity) are selected to coincide each other, the line 11 and the line 21 are generated, and then, the length of the line 11 and the length of the line 21 coincide using the arbitrarily selected arm length such that the line 11 and the line 21 are overlapped, the line 12 is formed at the end of the line 11 to have an angle between the user's arm and club, and the length of the line 12 is formed to have an arbitrarily selected club length, the line 22 is formed at the end of the line 21 to have an angle between the comparative model's arm and club, and the length of the line 22 is formed to have the same arbitrarily selected club length, and the line 12 and the line 22 have the same length, but are compared with each other.

Additionally, if the angle between the line 12 and the line 22 exceeds a predefined range, a difference value is displayed.

In addition, in the specific golf swing stage, if the angle of the user's arm and the angle of the comparative model's arm do not coincide, an angle of the user's arm that is adjacent to the back-and-forth direction of the swing corresponding to the angle of the model's arm is selected from the user's data, the angle of the user's arm matching the angle of the model's arm is calculated by interpolation, and then, trajectories of the user's arm and club and trajectories of the model's arm and club according to the calculated angle of the user's arm are simultaneously displayed and compared.

Moreover, the specific stages of the golf swing includes an address stage, a backswing stage, a top of the backswing stage, a downswing stage, an impact stage, a follow-through stage, and a finish stage.

Furthermore, throughout all stages of the golf swing, the trajectories of the user and the model are continuously displayed and compared.

Additionally, during the backswing, cocking start points of the user and cocking start points of the comparative model are simultaneously displayed and compared, and when the angle between the arm and the club belongs to a specific range during the backswing, it is determined that cocking starts.

In addition, uncocking start points of the user and uncocking start points of the model during the downswing are simultaneously displayed and compared, and the uncocking start point is determined when the angle between the arm and the club falls within a specific range.

The above and other objects, features and advantages of the present invention will be more clearly understood from the following detailed description taken in conjunction with the accompanying drawings.

The terms and words used in the specification and claims must not be limited to typical or dictionary meanings, but must be regarded as concepts selected by the inventor as concepts which best illustrate the present invention, and must be interpreted as having meanings and concepts adapted to the scope and spirit of the present invention to aid in understanding the technology of the present invention.

As described above, according to the present invention, the method for analyzing the golf swing enables more accurate golf swing analysis by comparing the user's golf swing with the golf swing of the comparative model using the standardized arm and club lengths despite variations in the user's body size or club length.

DETAILED DESCRIPTION OF THE PREFERRED EMBODIMENT

Figure 1:
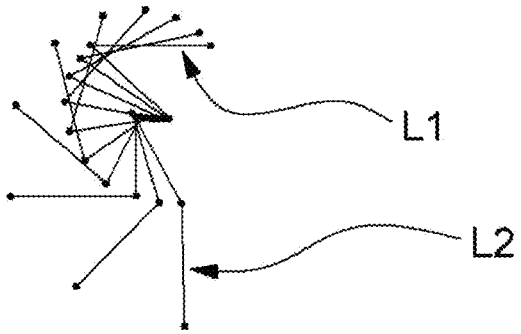
FIGS. 1 and 2 are schematic diagrams illustrating a method for analyzing the golf swing according to an embodiment of the invention.
Figure 1:
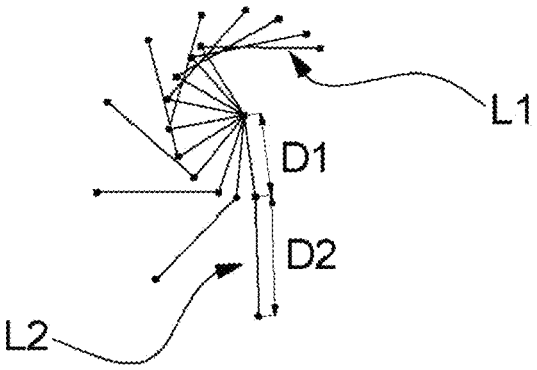
Figure 1:
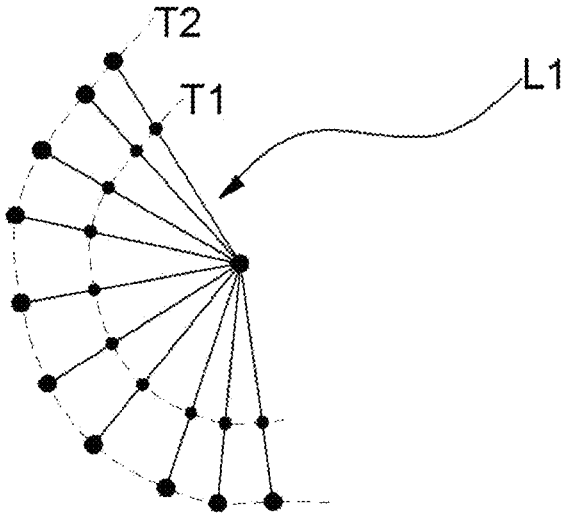

Hereinafter, preferred embodiments of the present invention will be described with reference to the accompanying drawings. In the drawings, thicknesses of lines and sizes of constituent elements may be exaggerated for clarity and convenience in explanation.

Furthermore, terms to be described later are defined in consideration of the functions of the present invention, and may differ depending on the intentions of a user or an operator or custom. Accordingly, such terms should be defined on the basis of the contents of the overall specification.

In addition, the embodiment disclosed hereinafter does not limit the scope of the present invention, but corresponds to merely exemplary terms of constituent elements presented in claims of the present invention, and the embodiments that include replaceable constituent elements as equivalents of the constituent elements defined in the overall specification and claims may be included in the scope of the present invention.

A method for analyzing the golf swing according to an embodiment of the present invention, as illustrated in FIGS. 1 through 6, calculates an angle of the golf swing of a user and an angle of the golf swing of a comparative model using a first inertial sensor mounted on the user's arm and a second inertial sensor mounted on one side of a golf club. Since the inertial sensors and the method of angle calculation are described in the Background Art (Korean Patent Publication No. 10-2024-0028826) in detail, further description and illustration thereof will be omitted.

The user's angles involve the angles of the user's arm and the club, and the model's angles involve the angles of the comparative model's arm and club. The user's golf swing will be analyzed by comparing the angle data.

In this instance, to compare the user's golf swing with the comparative model's golf swing, arbitrarily selected lengths of the arms and clubs are used. When the selected lengths are used, the trajectories of the user's arm and the club and the comparative model's arm and the club are simultaneously displayed to be compared. Meanwhile, the inertial sensor provided on the arm is preferably provided on the forearm where there is no wrist movement. Since the inertial sensor is described in the Background Art (Korean Patent Publication No. 10-2024-0028826) in detail, further description and illustration thereof will be omitted.

Referring to FIG. 1, the present invention will be described in more detail. FIG. 1(*a*) represents the angle values measured by the inertial sensor, wherein the user's arm or the comparative model's arm is represented as first lines L1, and the user's club or the comparative model's club is represented as second lines L2. In this instance, starting positions of the first lines L1 are different, which is due to the phenomenon of the arm's starting position moving along the shoulder line during the golf swing.

As illustrated in FIG. 1(*b*), the first lines L1 are arranged such that all starting points of the first lines L1 coincide when the first lines L1 are formed. In this instance, the second lines L2 are formed at the ends of the first lines L1.

A length D1 of the first line L1 is an arbitrarily selected length of the arm. In this instance, the arbitrarily selected length of the arm may be the length of the user's arm or the comparative model's arm.

A length D2 of the second line L2 is an arbitrarily selected length of the club. In this instance, the arbitrarily selected length of the club may be the length of the user's club or the comparative model's club.

Accordingly, the first lines L1 of the user and the first lines L1 of the comparative model may be the same, the second lines L2 of the user and the second lines L2 of the comparative model may be also the same.

That is, the angle values measured by the inertial sensor are independent of the lengths of the arm or the club. FIG. 1(*c*) illustrates only the first lines L1 to show the above accurately. As illustrated in FIG. 1(*c*), a first trajectory T1 is obtained by applying a specific arm length, and a second trajectory T2 is obtained by applying a length longer than that of the first trajectory T1. As illustrated in FIG. 1(*c*), since the first lines L1 corresponds to angles at measurement points, the angle values remain consistent regardless of the lengths applied. For instance, even if the user's arm length is used as a reference, both the user's and the comparative model's arm trajectories can be compared simultaneously, and conversely, even though the model's arm length is applied as a reference, the trajectories of the user's arm can be compared simultaneously.

In other words, according to this invention, the angle measurements are unaffected by changes in the arm or club lengths of the user or in the arm or club lengths of the comparative model, enabling more accurate evaluations compared to other data.

Figure 2:
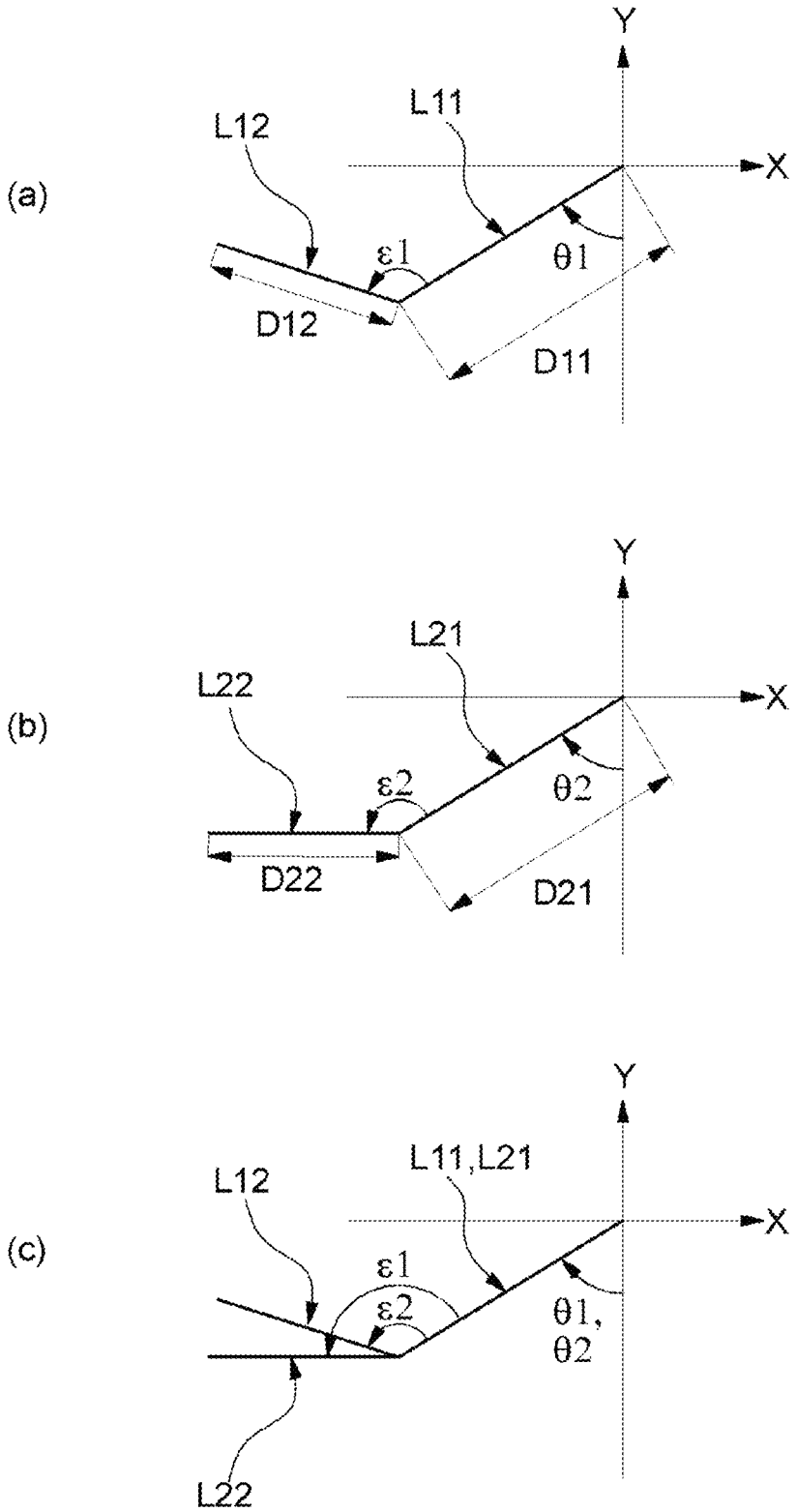

Referring to FIG. 2, the present invention will be described in more detail. The first line L1 may include a line 11 L11 corresponding to the user's arm, and a line 21 L21 corresponding to the comparative model's arm, and the second line L2 may include a line 21 L21 corresponding to the user's club, and a line 22 L22 corresponding to the comparative model's club.

In this instance, angles θ1 and 02 (angle between the arm and a straight line in the direction of gravity) are selected to coincide each other. In other words, data where the arm angles of the user and the comparative model coincide (Θ1-Θ2) during the movement are chosen (see FIGS. 2(*a*) and 2(*b*)).

As illustrated in FIG. 2(*c*), the line 11 L11 and the line 21 L21 are generated, and then, the length D11 of the line 11 L11 and the length D21 of the line 21 L21 coincide using the same arbitrarily selected arm length. For instance, the line 11 L11 representing the user's arm and the line 21 L21 representing the comparative model's arm are matched in length using the user's arm length. Through the above process, as illustrated in FIG. 2(*c*), the line 11 L11 and the line 21 L21 coincide.

Meanwhile, the line 12 L12 is formed at the end of the line 11 L11 to have an angle (81) between the user's arm and club, and the length D12 of the line 12 L12 is: formed to have an arbitrarily selected club length.

Furthermore, the line 22 L22 is formed at the end of the line 21 L21 to have an angle (ε1) between the comparative model's arm and club, and the length D22 of the line 22 L22 is formed to have the same arbitrarily selected club length.

By the above stage, the line 12 L12 and the line 22 L22 have the same length, but the angles are different, so as to be compared with each other.

Meanwhile, it is evident that the lengths D12 and D22 of the line 12 L12 and the line 22 L22 can be matched each other using various standards.

As described above, in a specific swing stage, the user's swing and the comparative model's swing are displayed simultaneously, thereby allowing for more accurate swing analysis.

Additionally, as mentioned above, in the present invention, since the angle information is extracted from the inertial sensor, accurate comparisons with other swing data can still be made even if the user's body is changed or the length of the club is changed.

In this instance, if the angle between the line 12 L12 and the line 22 L22 exceeds a predefined range, the swing analysis method may determine that the user's swing is incorrect, inform the user of the incorrect swing, and display the different value, for example, the different value in the angles ε1 and ε2 between the arm and the club on a designated image.

As described above, under the condition where the angle of the line 11 representing the user's arm and the angle of the line 21 representing the model's arm coincide, the lines of the club, namely, the line 21 L21 and the line 22 L22 were compared with each other.

Figure 3:
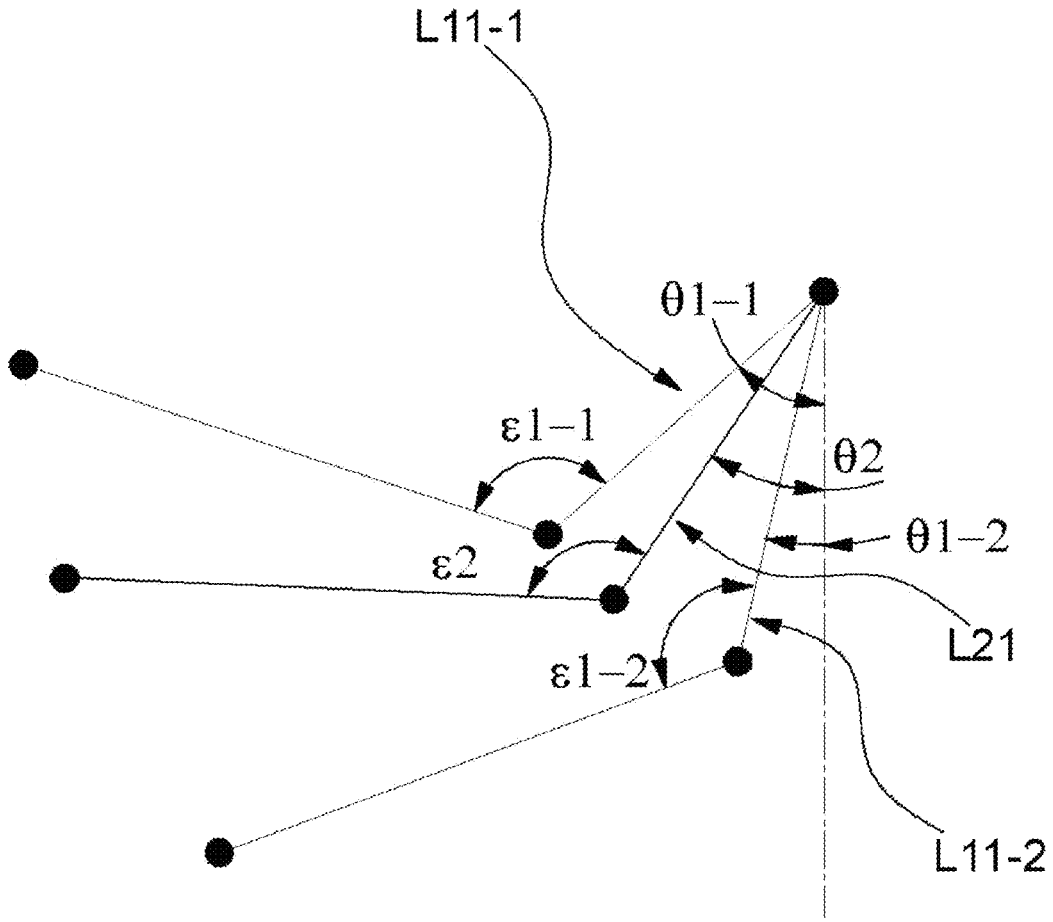
FIGS. 3 and 4 are schematic diagrams explaining the interpolation method used in the method for analyzing the golf swing according to an embodiment of the invention.

However, there are cases where the angles of the line 11 L11 and the line 21 L21 do not coincide according to the measured data. That is, as illustrated in FIG. 3, there may be no line 11 L11 of the user that matches the angle θ2 of the line 21 L21 representing the comparative model's arm. In such cases, an angle of the user's arm that is adjacent to the back-and-forth direction of the swing corresponding to the angle of the model's arm is selected. That is, it is also possible to select data of a line 11-1 L11-1 and a line 11-2 L11-2 of the user's arm adjacent to the line 21 L21 of the model's arm and calculate an angle of the arm and the club corresponding to the angles θ2 of the line 21 L21 of the model by interpolation. For instance, if there are an angle (Θ1-1) of the line 11-1 L11-1 and an angle (ε1-1) of the arm and the club, and an angle (Θ1-2) of the line 11-2 L11-2 and an club angle (ε1-2) of the arm and the club but there is no data for the angle (θ2) of the model's arm, the angle (c) between the user's arm and club corresponding to the angle of the model's arm can be obtained using the following Equation 1.

$$\varepsilon = \frac{\theta_2 - \theta_{1-1}}{\theta_{1-2} - \theta_{1-1}}(\varepsilon_{1-2} - \varepsilon_{1-1}) + \varepsilon_{1-1} \quad \text{[Equation 1]}$$

Figure 4:
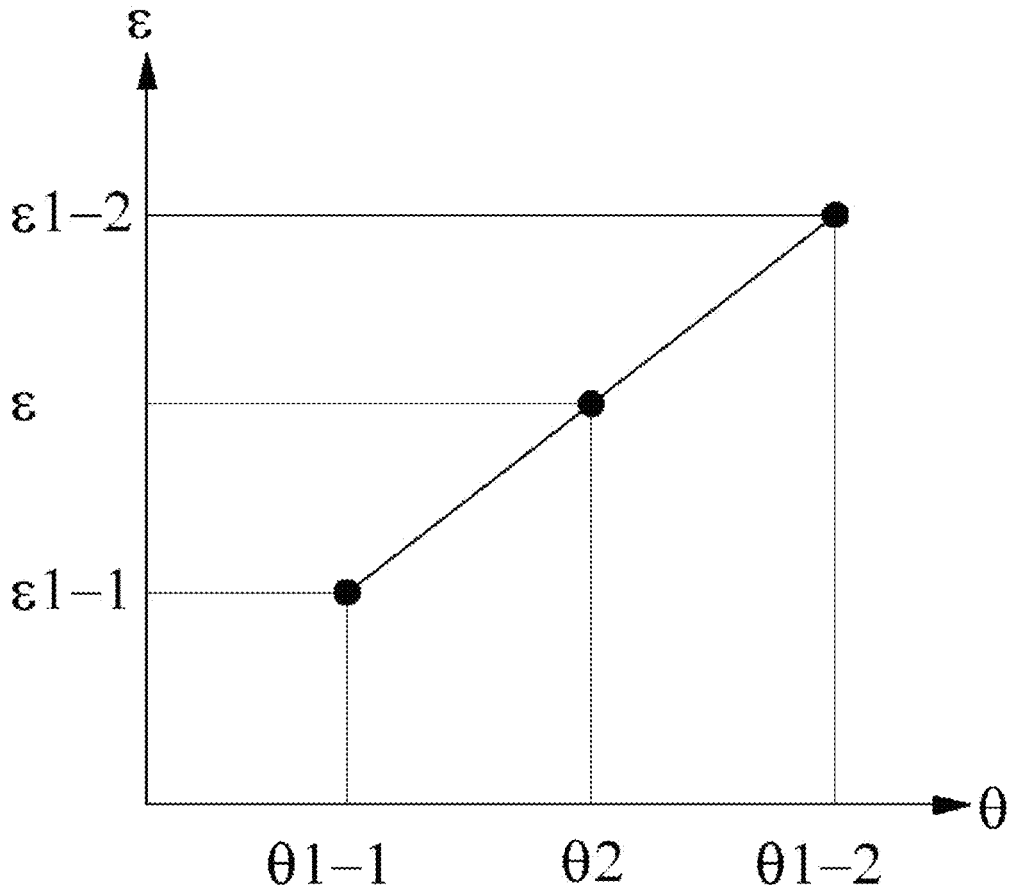

As illustrated in FIG. 4, assuming that the angle (E) between the arm and the club increases linearly with the angle of the arm by the interpolation, the angle (c) between the user's arm and club relative to the angle of the model's arm can be obtained using the interpolation. As described above, the present invention can simultaneously display and compare the trajectories of the user's arm and club and the model's arm and club.

Meanwhile, the user's golf swing and the model's golf swing can be compared by specific stages of the golf swing, and the specific stages of the golf swing may include an address stage, a backswing stage, a top of the backswing stage, a downswing stage, an impact stage, a follow-through stage, and a finish stage.

In this instance, it is also possible to continuously display and compare the trajectories of the user and the model throughout all stages of the golf swing.

Figure 5:
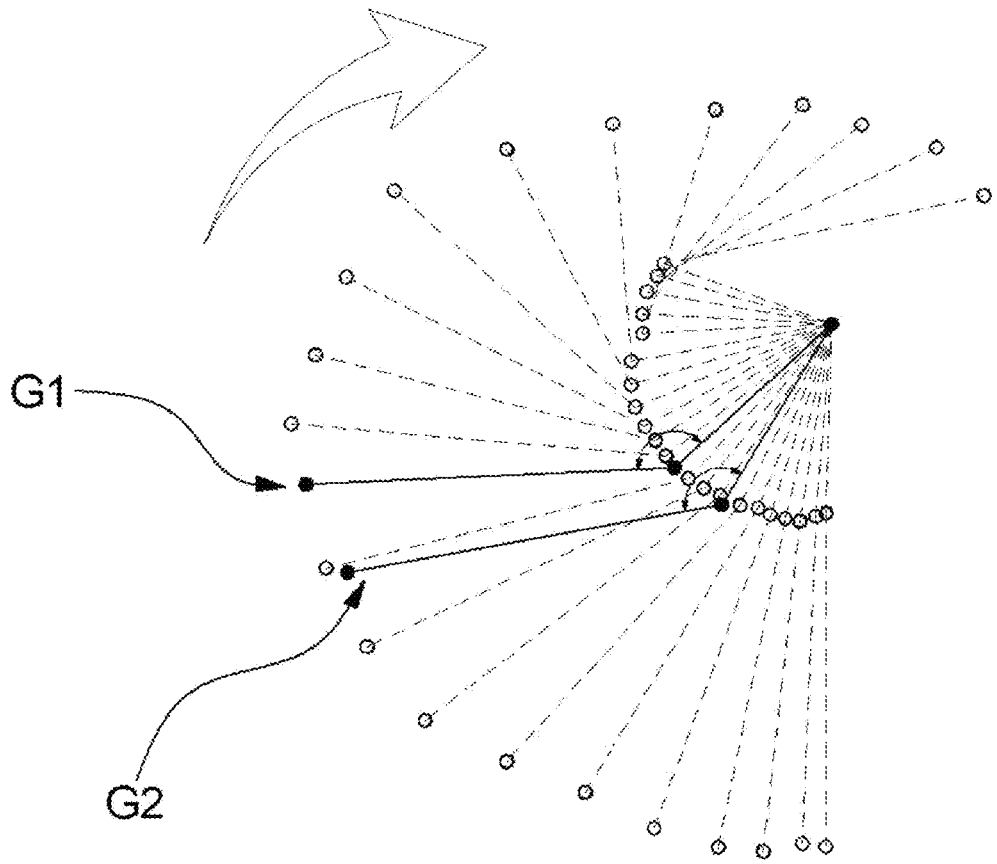
FIG. 5 is a schematic diagram illustrating the comparison of a cocking start point of a user during the backswing with that of a comparative model, in the method for analyzing the golf swing according to an embodiment of the invention.

Specifically, as illustrated in FIG. 5, during the backswing, cocking start points of the user and cocking start points of the comparative model are simultaneously displayed and compared, and it is possible to determine that cocking starts when the angle between the arm and the club belongs to a specific range during the backswing. That is, the cocking start point having a predetermined angle must start at a second point G2 like the model during the backswing. So, when the user starts cocking at a first point G1, the present invention may compare the cocking start points and inform the user of the comparison results.

Figure 6:
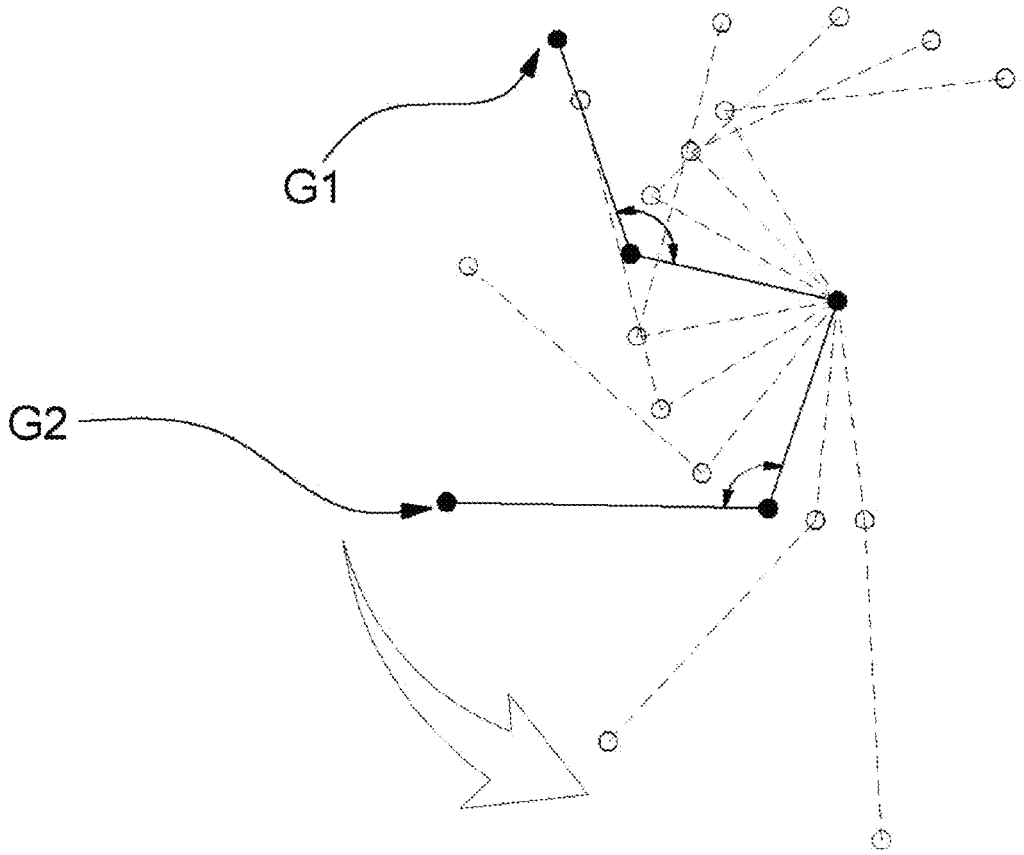
FIG. 6 is a schematic diagram illustrating the comparison of a uncocking start point of the user during the downswing with that of the comparative model in the method for analyzing the golf swing according to an embodiment of the invention.
Figure 7A:
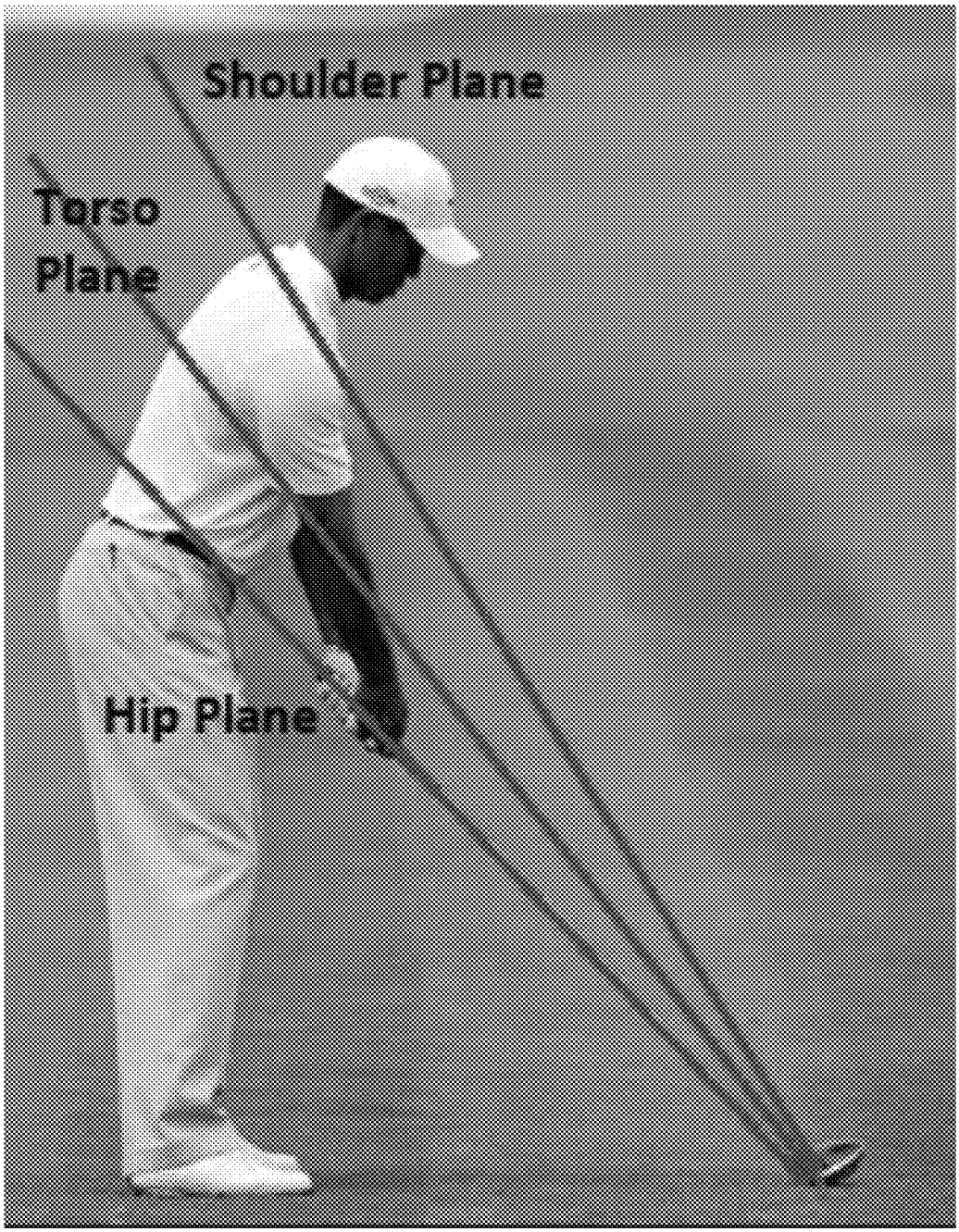
FIGS. 7A and 7B are schematic diagrams illustrating a conventional method for analyzing the golf swing.
Figure 7B:
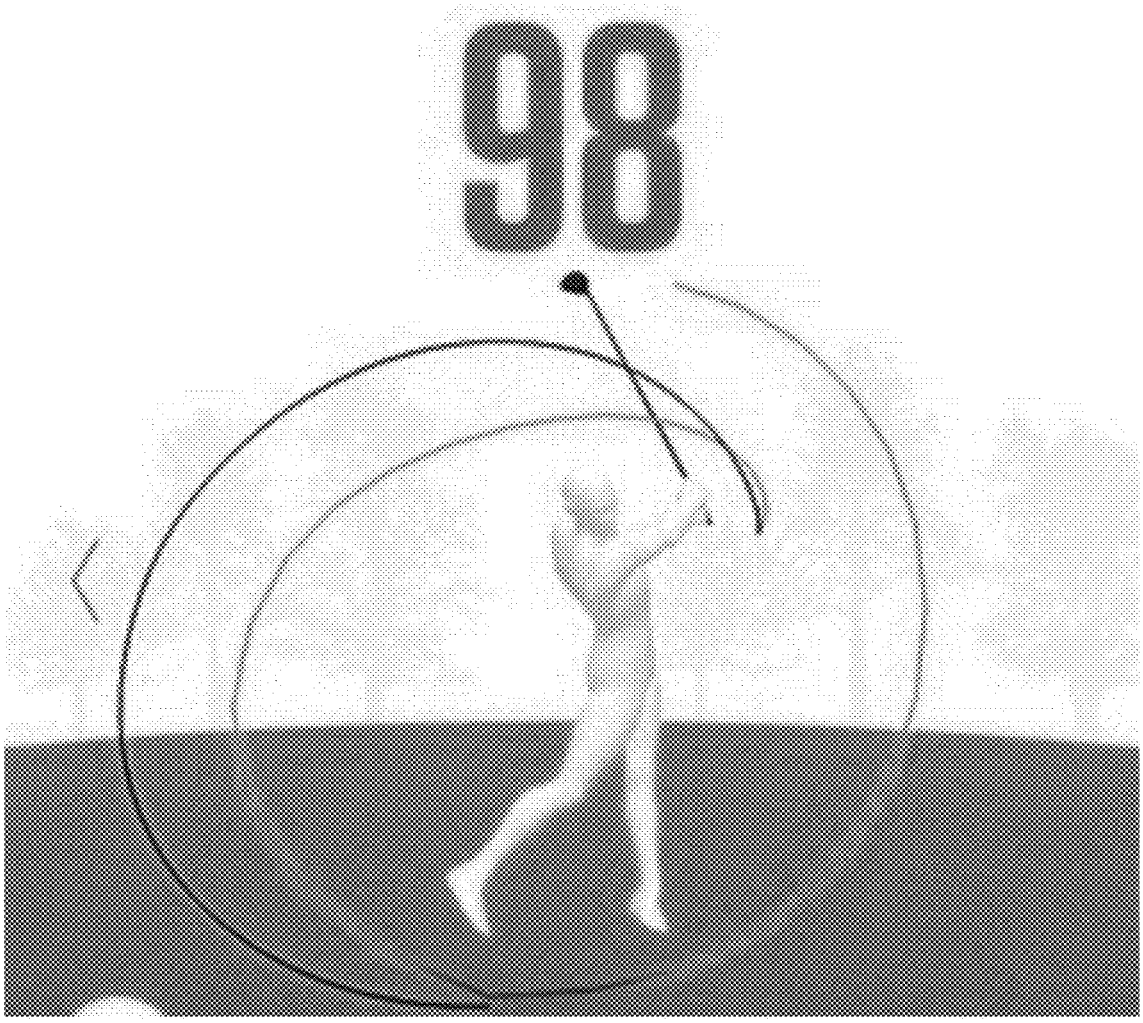

In addition, as illustrated in FIG. 6, it is also possible to simultaneously display and compare uncocking start points of the user and uncocking start points of the model during the downswing. In this instance, the uncocking start point is determined when the angle between the arm and the club falls within a specific range. That is, as illustrated in FIG. 6, during the downswing, the point of uncocking for the model is G2, and the point of uncocking for the user is G1, and the points G1 and G2 are simultaneously displayed to allow for diagnosis of the user's golf swing.

Although exemplary embodiments of the present invention have been disclosed for illustrative purposes, it will be appreciated that the present invention is not limited thereto, and those skilled in the art will appreciate that various modifications, additions and substitutions are possible, without departing from the scope and spirit of the invention.

Accordingly, any and all modifications, variations or equivalent arrangements should be considered to be within the scope of the invention, and the detailed scope of the invention will be disclosed by the accompanying claims.

The invention claimed is:

1. A method for analyzing golf swing comprising:

using a first inertial sensor mounted on a user's arm and a second inertial sensor mounted on one side of a club to calculate user's angles of the user and comparative model's angles of a comparative model, wherein the user's angles are angles of the user's arm and the user's club, and the comparative model's angles are angles of the comparative model's arm and the comparative model's club, wherein trajectories of the user's arm and the user's club based on the user's angles and trajectories of the comparative model's arm and the comparative model's club based on the comparative model's angles are simultaneously displayed and compared by using arbitrarily selected lengths of the arm and the club, wherein the user's arm or the comparative model's arm is represented as first lines, and the user's club or the comparative model's club is represented as second lines, wherein the first lines are arranged such that all starting points of the first lines coincide when the first lines are formed, wherein the second lines are formed at ends of the first lines, wherein a length of the first line is an arbitrarily selected length of the arm, and a length of the second line is an arbitrarily selected length of the club, wherein the first line of the user and the first line of the comparative model are formed to have the same length, and the second line of the user and the second line of the comparative model are also formed to have the same length, and then, are compared with each other, wherein the first lines include a user's arm line corresponding to the user's arm, and a comparative model's arm line corresponding to the comparative model's arm, wherein the second lines include a user's club line corresponding to the user's club, and a comparative model's club line corresponding to the comparative model's club, wherein an angle between the user's arm and a straight line in a direction of gravity and an angle between the comparative model's arm and the straight line in the direction of gravity are selected to coincide with each other, wherein the user's arm line and the comparative model's arm line are generated, and then, a length of the user's arm line and a length of the comparative model's arm line coincide using the arbitrarily selected length of the arm such that the user's arm line and the comparative model's arm line are overlapped, wherein the user's club line is formed at an end of the user's arm line to have an angle between the user's arm and the user's club, and a length of the user's club line is formed to have an arbitrarily selected length of the club, wherein the comparative model's club line is formed at an end of the comparative model's arm line to have an angle between the comparative model's arm and the comparative model's club, and a length of the comparative model's club line is formed to have the same arbitrarily selected length of the club, and wherein the user's club line and the comparative model's club line have the same length, but are compared with each other.

2. The method according to claim 1, wherein when an angle between the user's club line and the comparative model's club line exceeds a predefined range, a difference value is displayed.

3. The method according to claim 1, wherein the specific stages of the golf swing includes an address stage, a backswing stage, a top of the backswing stage, a downswing stage, an impact stage, a follow-through stage, and a finish stage.

4. The method according to claim 1, wherein throughout all stages of the golf swing, the trajectories of the user and the model are continuously displayed and compared.

5. The method according to claim 1, wherein during the backswing, cocking start points of the user and cocking start points of the comparative model are simultaneously displayed and compared, and wherein when the angle between the arm and the club belongs to a specific range during the backswing, it is determined that cocking starts.

* * * * *